US005609226A

United States Patent [19]

Penisson

[11] Patent Number: 5,609,226

[45] Date of Patent: Mar. 11, 1997

[54] SLIP-TYPE GRIPPING ASSEMBLY

[76] Inventor: Dennis J. Penisson, 319 Willow St., Raceland, La. 70394

[21] Appl. No.: 548,334

[22] Filed: Nov. 1, 1995

Related U.S. Application Data

[62] Division of Ser. No. 288,082, Aug. 9, 1994, Pat. No. 5,484,040, which is a continuation of Ser. No. 994,640, Dec. 22, 1992, Pat. No. 5,335,756.

[51] Int. Cl.[6] ..... E21B 19/10

[52] U.S. Cl. ..... 188/67; 175/423

[58] Field of Search ..... 188/67; 175/423

[56] References Cited

U.S. PATENT DOCUMENTS

| | | | |
|---|---|---|---|
| 1,834,316 | 12/1931 | McLagan . | |
| 2,061,771 | 11/1936 | McLagan . | |
| 2,061,772 | 11/1936 | McLagan . | |
| 2,063,361 | 11/1936 | Baash | 175/423 |
| 2,131,400 | 9/1938 | Johnson et al. . | |
| 3,365,762 | 1/1968 | Spiri | 188/67 |
| 3,748,702 | 7/1973 | Brown | 188/67 |
| 4,306,742 | 12/1981 | Hardcastle | 188/67 |
| 4,715,456 | 12/1987 | Poe, Jr., et al. | 188/67 |
| 5,335,756 | 8/1994 | Penisson | 188/67 |

FOREIGN PATENT DOCUMENTS 323333 1/1930 United Kingdom .

*Primary Examiner*—Matthew C. Graham
*Attorney, Agent, or Firm*—Browning Bushman

[57] ABSTRACT

A slip-type gripping assembly comprises an outer body defining a longitudinal through opening for receipt of the object. A number of slip bodies are circumferentially spaced about the through opening and are radially movable toward and away from the locus of the object. Each slip body is pivotable about a generally longitudinal axis generally circumferentially centered with respect to the slip body as well as about a tangential axis. A respective force transfer formation is cooperative between each slip body and the outer body for transferring radial force therebetween while permitting the pivoting.

20 Claims, 3 Drawing Sheets

SLIP-TYPE GRIPPING ASSEMBLY

This is a division of application Ser. No. 08/288,082, filed Aug. 9, 1994, now U.S. Pat. No. 5,484,040 which is a continuation of 07/994,640, filed Dec. 22, 1992, now U.S. Pat. No. 5,335,756.

BACKGROUND OF THE INVENTION

The present invention pertains to slip-type assemblies for gripping and suspending objects, especially tubular goods such as drill pipe or production tubing. Such an assembly comprises a plurality of circumferentially spaced slip bodies surrounding the locus of the pipe or other object and which in turn are generally surrounded by a generally outer body known as a "bowl." By means well known in the art, the device can be initially emplaced about one section of pipe in a string. The inner sides of the slip bodies carry gripping means, usually in the form of teeth formed on hard metal dies, for biting into and frictionally engaging the pipe. The outer sides of the slip bodies and/or the opposed inner side of the bowl may have surfaces which are inclined radially inwardly and downwardly. Because the slip bodies can move both longitudinally and radially with respect to the bowl, these inclined surfaces serve as camming surfaces. Thus, when the weight of the pipe is let down on the device, so that it tends to move the slip bodies downwardly with respect to the bowl, the camming surfaces urge the slip bodies radially inwardly and into tighter engagement with the pipe, so that the mechanism is self-tightening.

In a typical well drilling operation, two such assemblies are typically employed in, for example, pulling a string of drill pipe or other tubular goods from the well. One such assembly, located at the rotary table, is typically referred to simply as the "slips." The other, which is located above the slips and can travel vertically up and down, is called the "elevator."

If, for example, a string of pipe is being tripped from a well, e.g. to change the drill bit, then with the elevator gripping one of the upper sections of drill pipe, the slips in the rotary table can be released, and the elevator with the pipe carried thereby can be raised farther above the rotary table. The slips in the rotary table can then be engaged with the pipe, so that they support the pipe, and the elevator can be released and moved downwardly to take another bite at a lower point on the drill string. Of course, between the above steps, various sections of drill pipe can be detached from the top of the string as they incrementally clear the elevator.

In general principle, such devices have changed little since they first came into use many years ago. One reason is that, being self-tightening by the very weight of the objects they support, they are considered "fail safe." There are other advantages, including the fact that the devices are relatively simple in construction and operation.

They have not, however, been without problems. Although the dies which actually frictionally engage the pipe or other tubular goods are contoured to generally conform to the curvature of the pipe, pipe damage can still occur. Typically, really objectionable pipe damage occurs when the slip bodies are not properly aligned with the pipe, so that their contours are misfit with those of the pipe. This can occur, for example, if the camming surfaces between the slip bodies and the bowl wear unevenly, if the gripping teeth on the dies wear unevenly and/or become damaged, if the assembly as a whole is not level, and for other reasons.

When this occurs, the pipe may not only be deformed, but stress risers can be set up, which may result in premature pipe failure.

This problem is, in a sense, self-exacerbating. Because the slip bodies in prior art devices do not reliably align well enough to provide uniform pressure by all the die teeth, it is common to use sharper teeth so that those which do engage the pipe firmly can support it. However, such teeth are the very ones to cause most damage when the slip bodies are misaligned.

Some prior patents have partially addressed this problem by providing assemblies in which the slip bodies can articulate to adjust for misalignments in longitudinal planes. Examples are U.S. Pat. No. 1,834,316 to McLagan, U.S. Pat. No. 2,061,771 to McLagan, U.S. Pat. No. 2,061,772 to McLagan, U.S. Pat. No. 2,063,361 to Baash. U.S. Pat. No. 2,131,400 to Johnson is similar, but adds a floating hinge to assist in slip body alignment.

The above systems for longitudinal articulation, however, have not been totally satisfactorily. The die surfaces and pipe surfaces may still be misaligned in lateral planes, and the aforementioned damage can still occur. Typically, the only lateral adjustment permitted was by virtue of hinged connections between adjacent slip bodies, which would allow the generally circular locus of the group of slip bodies as a whole to "open up" to disengage the slip bodies from the pipe. It can be appreciated that this type of movement would not allow for proper alignment of the contour of the die with the pipe surface, but on the contrary, could be counterproductive.

SUMMARY OF THE INVENTION

The present invention provides a system whereby individual slip bodies in a "slips" assembly, an elevator, or other slip-type assembly for gripping an object, can each articulate or pivot in a lateral plane, preferably while still remaining able to articulate or pivot in a longitudinal plane. Because each slip body can articulate independently of the other slip bodies, and in both longitudinal and lateral planes, it is possible to properly align all the slip bodies in the assembly with the pipe or other object even if the assembly as a whole is not level, if there has been uneven wear of the parts of the assembly, etc.

As a result, the forces with which the various die teeth contact the tubular goods are more nearly equalized, and no one tooth is likely to penetrate too deeply. This is advantantageous in itself and also results in ancillary advantages. For example, certain tooth designs were previously avoided because they could not reliably grip the pipe if the slip bodies were misaligned. With the improved alignment made possible by the invention, these tooth designs become reliable, and they, in turn, further reduce the chance of damage. Thus, the net effect may be considered synergistic.

In preferred embodiments a setting means is provided for advancing the slip bodies radially inwardly, toward the pipe or other object to be gripped, with a relatively low force before the full weight of the pipe is imposed on the assembly. This not only helps to ensure that there is engagement, and therefore gripping, when the weight is imposed, but in a self-tightening device, may also allow the slip bodies to articulate and align with the pipe under a relatively low force, so that they are properly aligned before the high pipe force, which could cause great damage, is imposed. Under the force of the setting means, the pivotable slip bodies sort of cam themselves into proper alignment with the pipe by engagement therewith. The relatively low magnitude of the force also allows the weight of the pipe to override the setting means when the full weight of the pipe is taken by the assembly. Thus, when actually supporting the pipe, the assembly is self-tightening, as in the prior art, and there need be no worry that accidents will occur should there be failure of the setting means after the pipe has been supported by the assembly.

More particularly, each slip body in an assembly, in order to articulate in a transverse or lateral plane, is pivotable about a respective longitudinal axis. Because this axis is circumferentially centered with respect to the slip body, the contour of its inner side (which typically is defined by the die) can properly align with the pipe, and will not be engaged more tightly at one end of the arc than at the other. The slip body is preferably also pivotable about a tangential axis, so that it can articulate in a longitudinal plane, and this axis is also preferably generally centered, but longitudinally, with respect to the respective slip body.

A respective force transfer means is preferably provided to cooperate between each slip body and the outer body or bowl for transferring radial force between those two bodies while still permitting the longitudinal and transverse pivoting. Even more preferably, each force transfer means has a pivot surface which is contoured to an apex generally circumferentially centered with respect to the respective slip body, the contour permitting the aforementioned pivoting about the longitudinal axis for lateral articulation.

In those embodiments in which a single force transfer member is provided for each slip body, the pivot surface is likewise contoured in a longitudinal plane and forms an apex in that plane, which coincides with the apex in the transverse plane. In other embodiments, a pair of pivot members may be provided for each slip body, one having a circumferentially contoured pivot surface, and the other having a longitudinally contoured pivot surface.

In any case, a force transfer member may preferably be mounted in either the slip body or the opposed portion of the outer body or bowl, and the body in which it is so mounted may have a contoured bearing surface mating with the pivot surface. An oversized or loose connection may be provided to retain the pivot member on the body in which it mounted, while still permitting the necessary movement.

Where the aforementioned connection is provided, the pivot member and/or a seat or mounting portion of the body in which it is mounted may be connected to a main body portion by means which allow limited radial play with respect to the main body portion.

Additional details of the invention and/or various embodiments thereof, as well as various objects and advantages of the invention, will be made apparent by the following detailed description, the drawings, and the claims.

DETAILED DESCRIPTION

Figure 3:
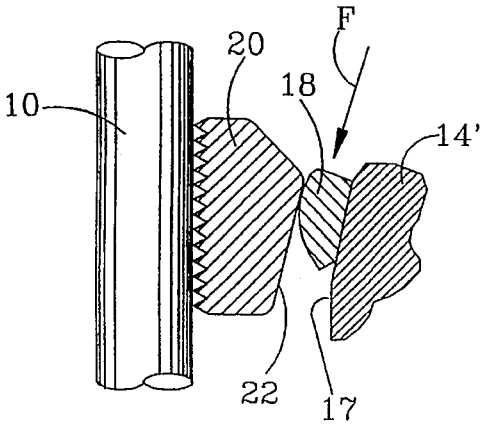
FIG. 3 is a view similar to that of FIG. 1 illustrating further principles in a second simplified embodiment.
Figure 4:
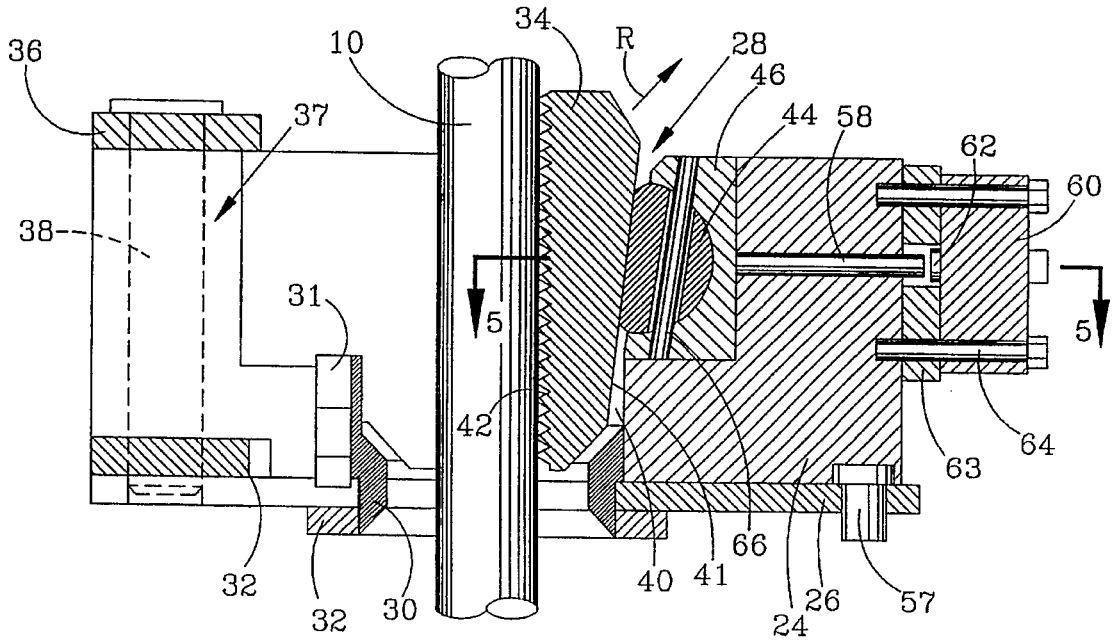
FIG. 4 is a longitudinal cross-sectional view through a more detailed embodiment of the invention.
Figure 6:
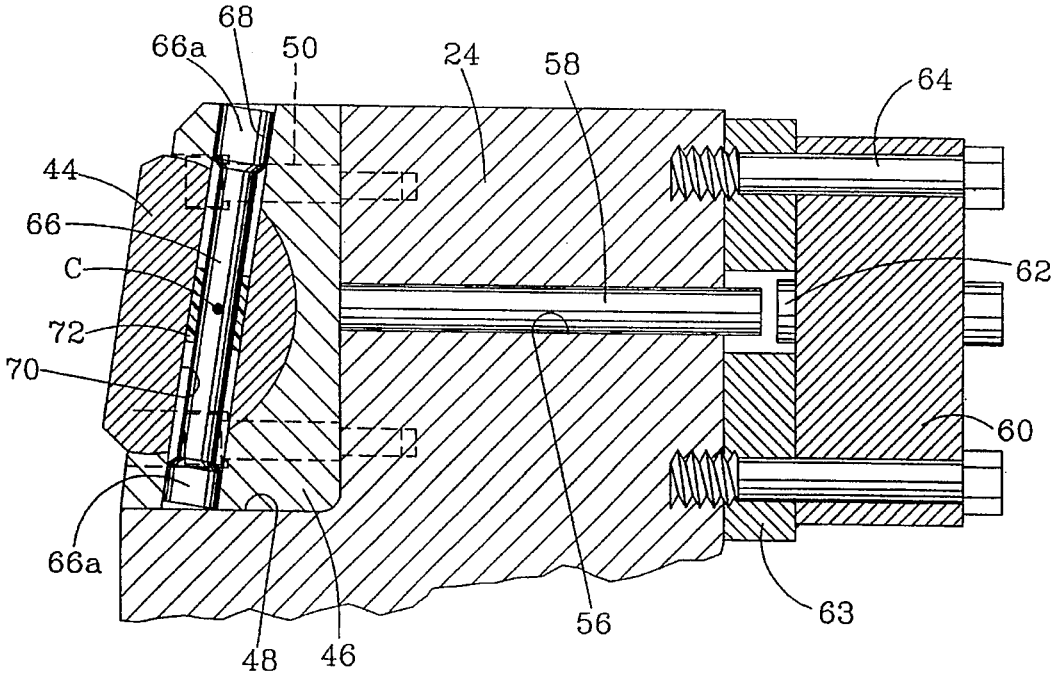
FIG. 6 is an enlarged, detailed cross-sectional view through one of the pivot members and adjacent parts.
Figure 5:
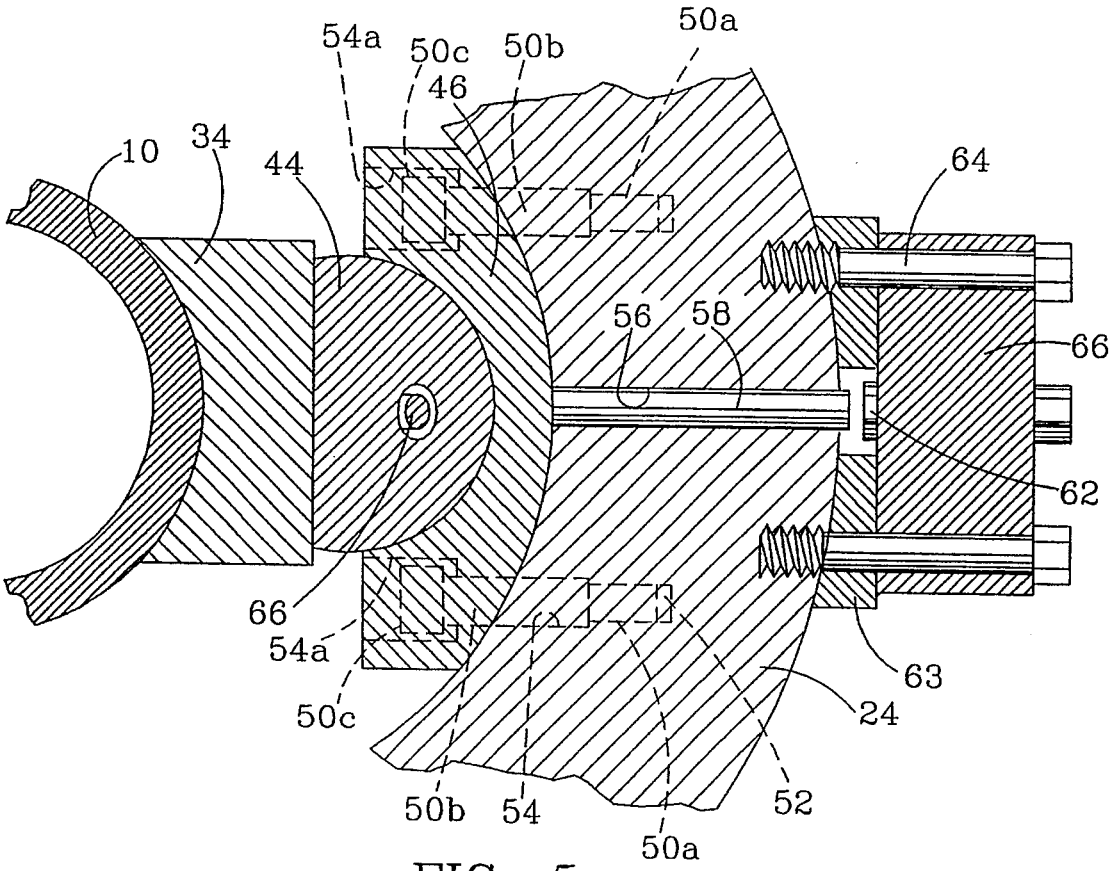
FIG. 5 is a partial transverse cross-sectional view taken on the line 5—5 of FIG. 4.

FIGS. 4–6 illustrate one preferred embodiment of slips assembly according to the present invention. However, that preferred embodiment will be better understood if certain principles are first described in connection with the simplified, diagrammatic views of FIGS. 1–3.

Figure 1:
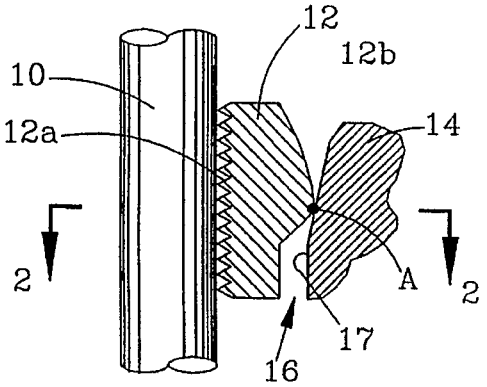
FIG. 1 is a diagrammatic, fragmentary, longitudinal view illustrating principles of the invention in a simplified embodiment.
Figure 2:
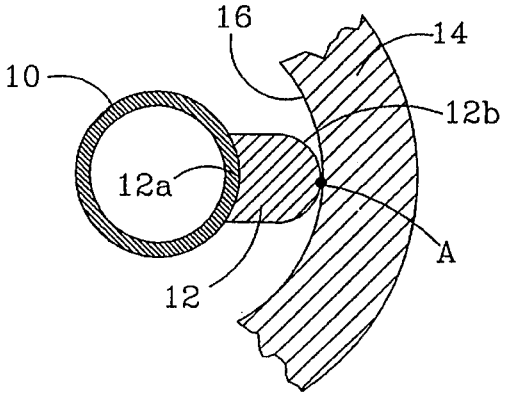
FIG. 2 is a transverse cross-sectional view taken on the line 2—2 of FIG. 1.

FIGS. 1 and 2 illustrate a very simple case. There is shown a portion of a length of drill pipe 10 to be supported by the slips assembly. Pipe 10 is supported by being frictionally engaged by three slip bodies, one of which is shown at 12. The slip bodies are surrounded by an outer body or bowl, a fragment of which is shown at 14. The bowl 14 defines a longitudinal through opening 16. The slip bodies 12 are symmetrically circumferentially spaced about the outer part of the opening 16, and the pipe 10 extends through the center of the opening 16, surrounded by the slip bodies.

Each slip body 12 has an inner side 12*a* provided with teeth for frictionally engaging the pipe 10. Although, for simplicity, the teeth are shown as integrally formed on the slip body 12, they could be formed on a separate die carried on the slip body, as is well known in the art. The outer side of the slip body has a force transfer protuberance 12*b*. As may be seen by comparing FIGS. 1 and 2, protuberance 12*b* is convexly curved in both longitudinal (FIG. 1) and transverse (FIG. 2) planes, and both curves reach a common apex at a point A. This apex A bears on the opposed inner side surface of the bowl 16, and more specifically, on a camming surface 17 which is inclined downwardly and inwardly. The slip bodies 12 are free to move both radially and longitudinally with respect to the bowl 16. Accordingly, when the weight of the pipe 10 is let onto the assembly, it tends to take the slip bodies down, and the slip bodies are thereby cammed radially inwardly by the surface 17, so that the grip on the pipe 10 is self-tightening.

As shown in FIG. 2, the curvature of protuberance 12*b* near its apex A in the transverse plane through A is on a shorter radius than that of the adjacent part of the bowl 14. (It can be seen that the radius of curvature of the adjacent part of the bowl is the same as a radius from the centerline of pipe 10 to apex A.) Thus there is essentially point contact at A in that plane. In the longitudinal plane of FIG. 1, there is of course point contact because the section of surface 17 is linear (it can be said that surface 17 has a radius of curvature of infinite length). Because of the point contact between apex A and surface 17, and because the slip body 12 is not constrained from doing so, the slip body 12 can pivot in both longitudinal and transverse planes. More specifically, body 12 can pivot in the transverse plane shown in FIG. 2 about the longitudinal axis passing through point A perpendicular to the plane of the drawing. ("Generally" longitudinal is used herein to mean that the axis or member has a significant vertical component of direction.) Furthermore, since point or apex A and the longitudinal axis passing therethrough are circumferentially centered on the slip body (with respect to the centerline of the assembly as a whole), this pivoting can allow the inner side 12*a*, which is concavely curved to correspond to the external curvature of pipe 10, to align itself perfectly with that curvature, so that it is not biting in more deeply at one end of the arc of side 12*a* than the other. The apex A is also approximately centered along the length of the slip body so that the tangential axis and radial force are also centered. Each of the slip bodies in a given assembly can so pivot independently of the others, so that the entire set of slip bodies properly aligns, and this will occur even if the rotary table (not shown) on which the assembly is carried is not level, if surface 17 has worn more adjacent one of the slip bodies than the others, if the slip bodies themselves have worn unevenly, or if for any other reason, surfaces 12*a* would otherwise have been imperfectly mated to the external curve of pipe 10.

To perfect the alignment in the longitudinal plane shown in FIG. 1, each slip body 12 can independently pivot in that longitudinal plane about a tangengential (true tangent or parallel to tangent) axis passing through point A perpendicular to the plane of the figure. Advantageously, point A is approximately longitudinally centered along the length of protuberance 12*b* as shown.

It will be appreciated that similar results could be obtained if the inclined camming surface were formed on the slip body, and the convexly curved protuberance providing the pivot point were formed on the bowl.

It can also be appreciated that, if the device were not of the self-tightening type, e.g. if camming surface 17 were replaced by an hydraulic cylinder capable of applying sufficent gripping force to body 12, and body 12 were still free to pivot about longitudinal and tangential axes, the same good alignment would be achieved.

FIG. 3 diagrammatically illustrates a slightly more complex embodiment in which a distinct force transfer member in the form of a wedge 18 is interposed between the bowl 14' and the slip body 20. The slip body 20 does not have the convexly curved protuberance of the first embodiment, but is provided with a downwardly and inwardly inclined camming surface 22 on its outer side. The wedge 18 has its inner side convexly curved in both longitudinal (FIG. 3) and transverse (not shown) planes so that it provides a transverse and longitudinal pivot point bearing on the camming surface 22 and allowing each slip body 20 to independently align with the pipe 10 as in the preceding embodiment. The outer side of wedge 18 is shaped to conform with the opposed camming surface 17 of the bowl 14'. Similar results could be achieved if the inner side of wedge 18 were shaped to conform with surface 22, and the outer side convexly curved to provide point contact with surface 17.

It can be seen that wedge 18 will also transfer forces between camming surfaces 17 and 22 so that the camming surfaces are still cooperative, though indirectly, between bodies 14 and 20. It can also be appreciated that, if some means, diagrammatically indicated by arrow F, is provided for urging the wedge 18 downwardly between the camming surfaces 17 and 22, the inclination of the camming surfaces will cause the slip body 20 to be urged radially inwardly toward the pipe 10. It can be appreciated that, if this is done with a relatively low force, i.e., lower than that of the pipe 10, before the weight of the pipe 10 is let onto the assembly, the slip bodies can be pre-aligned with the pipe; they will in effect cam themselves into proper positions by virtue of contact with the pipe 10 and their independent pivotability. However, the low force of means F will allow this to happen without damage. Also, pre-engagement with the pipe 10 will be ensured, so that the slip bodies will be urged down and tightened by the weight of the pipe. Use of the wedge 18 also eliminates the need to directly lift the slip bodies to release them. Rather, the wedge(s) can be retracted.

As mentioned, the embodiments of FIGS. 1–3 are simplified and diagrammatically illustrated. In each of these embodiments, there would be sliding movement between the pivot point and the opposing surface, and this could lead to relatively fast wear of those sliding surfaces. FIGS. 4–6 illustrate a more detailed embodiment which provides the aforementioned advantages in terms of adjustability of the slip bodies, but with a substantial surface area for contact between each pair of abutting, relatively movable surfaces. Certain parts of the slips assembly of FIGS. 4–6 which are well known in the art and do not form a part of the present invention have been omitted from or simplified in the drawings for clarity of illustration and efficiency of description.

The bowl includes main body portion 24 resting on a base plate 26. One or more locator pins 57 may be provided to position the apperatus with respect to the rotary table. As in the preceding embodiments, the body 24 and plate 26 define a central longitudinal through opening 28 for the pipe 10. The bowl further includes a guide ring 30 mounted in body 24 and plate 26 near, and defining the lower portion of, opening 28. The outer part of ring 30 is further supported by another ring 32. The upper surface of ring 30 partially opposes the slip bodies, one of which is shown at 34, to prevent them from falling out of the bowl, and its upper surface is inclined downwardly and inwardly as shown so as not to interfere with their movement. The upper portion of ring 30 also has lateral slots, one of which is shown at 40, loosely receiving respective slip bodies so as to generally maintain their circumferential spacing without interfering with their necessary movements.

With the exception of Ring 30, each of the otherwise annular parts of the bowl assembly, parts 24, 26, and 32, have aligned lateral slots so that the apparatus can be initially placed about the pipe 10, and subsequently removed, as is well known in the art. The slot 37 in main body portion 24 is selectively closed by links or gates 36 and 39 movably mounted to the body 24 by pins, one of which is shown at 38. Ring 30 does not have full-length lateral slots. Rather, it is formed in two halves connected by a hinge 31 so that, if lifted out of the main body, it can be opened to allow it to be placed about the pipe.

Each slip body has a downwardly and inwardly inclined camming surface 41 on its outer side, and pipe gripping teeth on its inner side 42, which is concavely curved to conform to the contour of the pipe 10. Generally opposed to the camming surface 40 of each slip body, there is a respective force transfer means in the form of a pivot member 44. The outer side surface of member 44 is generally convexly hemispherical in shape, so that it is curved in both longitudinal and transverse planes. In general, the greater the thickness of slip body 34, i.e. the greater the distance from the centerline to member 44, the greater should be the radius of curvature of member 44. This should help to avoid any possible toggling effect whereby one end of the slip body might be urged more tightly against the pipe than the other. In addition, the radially outmost point of the curved outer surface of member 44, and thus the line of force application, is approximately centered along the length of slip body 34. That is to say that it is aligned with the slip body somewhere along the centermost twenty-five percent (25%) of the length of the slip body. In the transverse plane of FIG. 5, the outermost point and the longitudinal axis are precisely centered.

In a manner to be described more fully below, member 44 is mounted in the bowl for longitudinal and transverse pivotal movement with respect to the bowl. Its inner side is shaped to. conform to or mate with the surface 41 and abuts that surface so that the aforementioned pivotal movement is transmitted to the slip body 34. Thus it provides the equivalent of the type of movement present in the preceding embodiments. However, its outer hemispherical side bears against a mating concave hemispherical surface in a mounting block 46 which is connected to main body 24 to form a part of the bowl. Thus, while providing the same type of movement, it avoids the point contact which can quicken wear and also avoids high point loads. Likewise, the inner side of member 44, conforming to the shape of camming surface 41, provides a large contact surface area on that side as well. The pivoting movement not only allows slip body 34 to align with pipe 10, but keeps the inner side of member 44 aligned with and fully abutting surface 40, so that the two serve as similarly inclined camming surfaces.

Referring now to FIGS. 5 and 6, mounting block 46 fits into a recess 48 in the inner side of main body 24 of the bowl. Mounting block 46 is connected to body 24 by screws 50. The shank of each screw 50 has a small diameter portion 50*a* adjacent its tip, and a larger diameter portion 50*b* adjacent its head 50*c*, so that a shoulder is formed between portions 50*a* and 50*b*. Body 24 has a threaded hole 52 for receipt of portion 50*a*, and block 46 has an unthreaded bore 54 for receipt of portion 50*b*. Bore 54 is counterbored at 54*a* to receive the head 50*c* of the screw. It can be seen that, when screw 50 is threaded all the way in, so that the shoulder formed between portions 50*a* and 50*b* is bottomed against the radially inwardly facing surface of recess 48, the head 50*c* of the screw is clearing the shoulder formed between the main portion of bore 54 and its counterbore 54*b*. Thus, mounting block 46 has some radial reciprocating type play with respect to body 24.

A radial bore 56 extends through main body 24, opening roughly centrally in the radially facing surface of recess 48. A push rod 58, longer than bore 56, extends therethrough. An hydraulic or pneumatic cylinder 60 is mounted on the outside of body 24 by any suitable means, diagrammatically shown at 64. The piston rod 62 protrudes, so that it can abut the protruding end of rod 58. A spacer plate 63 is interposed between cylinder 60 and bowl 24 and has a central bore for receipt of the protruding ends of rods 62 and 58. After the slip bodies have been lowered or roughly positioned in the well-known manner, by applying pressurized fluid to the outer side of the piston within cylinder 60 to move it inwardly with respect to the bowl, mounting block 46 can be pushed radially inwardly via rod 58 to the limit permitted by the clearance between screw head 50*c* and the facing shoulder in bore 54, carrying member 44 and slip body 34 with it. This serves a similar function to that indicated by the arrow F in FIG. 3, i.e. it sets the slip body 34 against the pipe 10, preferably under low force, so that slip body 34 cams itself into alignment with the pipe 10 before the weight of the drill pipe is applied, and also so that frictional engagement between the slip body and the pipe is ensured. As mentioned, the setting force applicable by piston and cylinder assembly 60 is preferably low, i.e. it is substantially lower than the radially outward force which will be applied by the weight of the pipe via the camming surface 44. Thus, once the weight of the pipe is let down, it will override cylinder 60. Self-tightening will take over, and there will be no danger of slippage if power to cylinder 60 is lost.

As mentioned, member 44 is mounted in block 46 for longitudinal and transverse pivotal movement. More specifically, a pivot pin 66 extends through aligned holes 68 and 70 in the mounting block 46 and member 44, respectively. Pin 66 has enlarged heads 66*a* at each end for tight fits in respective bores 68. They may be press fit into bores 68. However, the central portion of pin 66 which is received in the bore 70 is undersized with respect thereto. Thus the pin 66 per se, having a substantial longitudinal component of direction, forms an axis about which member 44 can pivot in a transverse plane, such as the plane of FIG. 5. Furthermore, due to the loose fit of pin 66 in bore 70, member 44 can also pivot in a longitudinal plane, such as that of FIG. 6, about a tangential axis C intersecting pin 66 about midway along its length. A soft, compressible sleeve 72 is interposed between pin 66 and bore 70 about midway. This helps in centering and stabilizing pin 66, but is sufficiently soft and compressible that it does not interfere with the requisite pivotal movement.

Each of the other slip bodies in the assembly would be similarly associated with a respective pivot member such as 44, in a respective mounting block, but it is unnecessary for the others to have respective piston and cylinder assemblies such as 60.

As is well known in the art, when it is desired to release the grip of the slip bodies, the pipe is lifted to relieve the slip bodies of its weight. Then the slip bodies are pulled upwardly with respect to the bowl by some low force means such as one or more hydraulic or pneumatic cylinders. A separate such means may be provided for each slip body, as indicated diagrammatically at R. They may be activated by a common source of pressurized fluid so that they will act in unison. Alternatively, a single such means may be provided, and the slip bodies may be connected and articulated for lateral spreading, in the well known manner.

Figure 7:
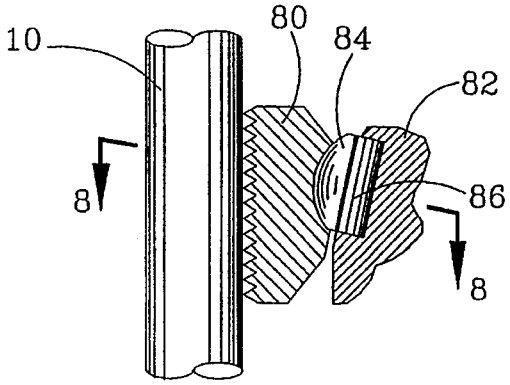
FIG. 7 is a view similar to those of FIGS. 1 and 3 illustrating a fourth embodiment.
Figure 8:
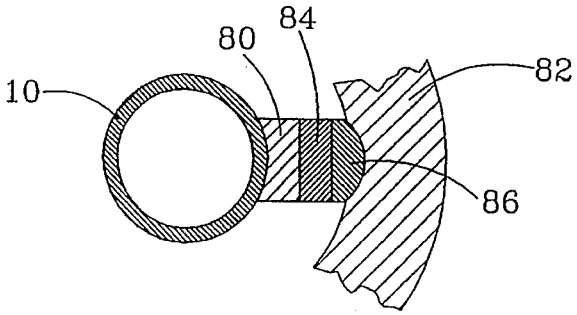
FIG. 8 is a cross-sectional view taken on the line 8—8 of FIG. 7.

All of the preceding embodiments of the invention utilize a single pivot member to provide for both longitudinal and transverse pivoting of the respective slip body. FIGS. 7 and 8 diagrammatically illustrate an embodiment which is similar to that of FIGS. 4–6, but employs a pair of pivot members for each slip body, one to provide longitudinal movement, and one to provide transverse movement.

Whereas the one pivot member provided in the embodiment of FIGS. 4–6 had a part spherical pivot surface, each of the two pivot members 82 and 84 in the embodiment of FIGS. 7 and 8 has a part cylindrical pivot surface, and these part cylindrically surfaces are oriented generally perpendicular to each other. One pivot member 86 is mounted in the bowl 82. Although shown in a simplified form, it will be understood by those skilled in the art that it could be mounted on a pivot pin, in turn mounted in a mounting block, in turn radially movable with respect to the bowl by a setting cylinder, all as in the embodiment of FIGS. 4–6. As shown in FIG. 8, it is the outer surface of member 86, which abuts a mating surface in the bowl, which is curved, and it is curved in a transverse plane so that it has a longitudinal pivot axis, i.e. an axis having a substantial longitudinal component.

The other pivot member 84 is mounted in the slip body 80 and has its inner surface convexly curved and bearing against a mating concave surface in the outer side of the slip body 80. It could be so mounted by a pivot pin. It is curved in a longitudinal plane, so that it can pivot in that plane about a tangential axis. The abutting surfaces of the members 84 and 86 are complementarily configured to serve as camming surfaces for the slip body 80. Together they provide both longitudinal and transverse pivotal movement for the slip body 80.

The above embodiments have been described as incorporated in "slips" assemblies, i.e. assemblies located at the rotary tables of their respective drilling rigs. However, slip type assemblies which are identical in terms of those parts which form the present invention could be incorporated in "elevator" assemblies or other gripping devises.

All of the embodiments shown are of the self-tightening type, i.e. they have camming surfaces responsive to the weight of the pipe. However, many of the principles of the invention could be applied to assemblies designed to grip only by virtue of a separately imposed force, e.g. from an hydraulic cylinder assembly.

Likewise, there are many other possible ways of pivotally mounting pivot members in bowls and/or slip bodies.

Numerous other modifications may suggest themselves to those of skill in the art. Accordingly, it is intended that the scope of the invention be limited only by the claims.

What is claimed is:

1. A method of gripping a tubular member with a plurality of slip bodies each disposed generally about an outer body, each slip body having gripping teeth on a radially inner surface thereof, the method comprising:

pivotably mounting each of a plurality of slip bodies with respect to the outer body about a respective tangential axis for radial movement of an upper portion of each slip body with respect to a lower portion of each slip body;

pivotably mounting each of the plurality of slip bodies with respect to the outer body about a respective longitudinal axis for radial movement of a left side of each slip body with respect to a right side of each slip body; and providing a longitudinal inclined camming surface for longitudinal movement of each slip body with respect to the outer body to radially move each slip body with respect to the outer body for gripping engagement with the tubular member.

2. The method as defined in claim 1, wherein the plurality of slip bodies are arranged circumferentially about a central body axis, and the steps of pivotably mounting further comprise:

curving a surface in a plane parallel to the central body axis for pivoting about the respective tangential axis; and curving a surface in a another plane perpendicular to the central body axis for pivoting about the respective longitudinal axis.

3. The method as defined in claim 2, wherein the steps of curving a surface further comprise:

forming a spherical-shaped surface carried on the outer body; and forming a mating spherical-shaped surface pivotable with respect to the outer body.

4. The method as defined in claim 1, further comprising:

uniformly positioning at least three slip bodies about the outer body.

5. The method as defined in claim 1, further comprising:

applying a radially inward force for initially engaging each of the plurality of slip bodies with the tubular member.

6. The method as defined in claim 1, further comprising:

providing a compressible member for facilitating pivotable movement of each of the plurality of slip bodies with respect to the outer body.

7. A method of gripping a tubular member with a plurality of slip bodies each disposed generally about an outer body, each slip body having gripping teeth on a radially inner surface thereof for gripping engagement with the tubular member when passing through the outer body, the method comprising:

mounting each of a plurality of slip bodies with respect to the outer body such that each slip body may pivot simultaneously about a respective tangential axis for radial movement of an upper portion of each slip body with respect to a lower portion of each slip body, and about a respective longitudinal axis for radial movement of a left side of each slip body with respect to a right side of each slip body; and providing a longitudinal inclined camming surface for longitudinal movement of each slip body with respect to the outer body to radially move each slip body with respect to the outer body for gripping engagement with the tubular member while allowing pivotable movement of each slip body with respect to the outer body.

8. The method as defined in claim 7, wherein mounting further comprises:

forming a curved surface in a vertical plane for pivoting of each slip body about the respect tangential axis; and forming a curved surface in a horizontal plane for pivoting of each slip body about the respective longitudinal axis.

9. The method as defined in claim 8 wherein forming a curved surface in a vertical plane and in a horizontal plane further comprises:

forming a spherical-shaped surface carried on the outer body; and forming a mating spherical-shaped surface pivotable with respect to the outer body.

10. The method as defined in claim 7, further comprises:

uniformly positioning at least three slip bodies about the outer body.

11. The method as defined in claim 7, further comprising:

applying a radially inward force for initially engaging each of the plurality of slip assemblies with the tubular member.

12. The method as defined in claim 7, further comprising:

movably interconnecting each of the plurality of slip bodies with the outer body.

13. The method as defined in claim 7, further comprising:

providing a compressible member for facilitating pivotable movement of each of the plurality of slip bodies with respect to the outer body.

14. A method of gripping a tubular member having a substantially vertical axis with a plurality of slip bodies each generally disposed between an outer body and the tubular member, the method comprising:

providing a radially inward gripping surface on each slip body for gripping engagement with the tubular member;

providing a longitudinal inclined camming surface on each slip body for radial movement of the respective slip body with respect to the outer body in response to longitudinal movement of the slip body with respect to the outer body for gripping engagement of the slip body with the tubular member; and mounting each of a plurality of slip bodies with respect to the outer body such that each slip body may pivot with respect to the outer body both within a vertical plane and about a respective tangential axis for radial movement of an upper portion of the slip body with respect to a lower portion of the slip body, and simultaneously within a horizontal plane and about a respective longitudinal axis for radial movement of a left side of the slip body with respect to a right side of the slip body, such that each slip body pivots for uniform engagement of the radially inward gripping surface with the tubular member.

15. The method as defined in claim 14, wherein mounting further comprises:

forming a curved surface in a vertical plane for pivoting of each slip body about the respective tangential axis; and forming a curved surface in a horizontal plane for pivoting of each slip body about the respective longitudinal axis.

16. The method as defined in claim 15, wherein forming a curved surface in a vertical plane and in a horizontal plane further comprises:

forming a spherical-shaped surface carried on the outer body; and forming a mating spherical-shaped surface pivotable with respect to the outer body.

17. The method as defined in claim 14, further comprises:

uniformly positioning at least three slip bodies about the outer body.

18. The method as defined in claim 14, further comprising:

applying a radially inward force for initially engaging each of the plurality of slip assemblies with the tubular member.

19. The method as defined in claim 14, further comprising:

movably interconnecting each of the plurality of slip bodies with the outer body.

20. The method as defined in claim 14, further comprising:

providing a compressible member for facilitating pivotable movement of each of the plurality of slip bodies with respect to the outer body.

* * * * *